US008274500B2

(12) United States Patent
Abe et al.

(10) Patent No.: US 8,274,500 B2
(45) Date of Patent: Sep. 25, 2012

(54) LIQUID CRYSTAL DISPLAY DEVICE

(75) Inventors: Hiroyuki Abe, Chiba (JP); Hideo Sato, Hitachi (JP); Masahiro Maki, Mobara (JP)

(73) Assignees: Hitachi Displays, Ltd., Hyogo-ken (JP); Panasonic Liquid Crystal Display Co., Ltd., Chiba (JP)

( * ) Notice: Subject to any disclaimer, the term of this patent is extended or adjusted under 35 U.S.C. 154(b) by 0 days.

(21) Appl. No.: 12/984,631

(22) Filed: Jan. 5, 2011

(65) Prior Publication Data

US 2011/0169788 A1 Jul. 14, 2011

(30) Foreign Application Priority Data

Jan. 14, 2010 (JP) ..... 2010-005903

(51) Int. Cl.
*G09G 5/00* (2006.01)

(52) U.S. Cl. ..... 345/204; 345/96; 345/205

(58) Field of Classification Search ..... 345/96, 345/204, 205, 211
See application file for complete search history.

(56) References Cited

U.S. PATENT DOCUMENTS

2006/0221034 A1* 10/2006 Nakao et al. ..... 345/92
2008/0122812 A1* 5/2008 Park et al. ..... 345/204
2010/0149156 A1* 6/2010 Maki et al. ..... 345/211

FOREIGN PATENT DOCUMENTS

JP 2006-276541 10/2006

* cited by examiner

*Primary Examiner* — Amare Mengistu
*Assistant Examiner* — Premal Patel
(74) *Attorney, Agent, or Firm* — Antonelli, Terry, Stout & Kraus, LLP.

(57) ABSTRACT

The present invention provides a liquid crystal display device where a common driver circuit formed of only a single channel transistor can be made smaller, wherein the counter electrode driving circuit has M basic circuits that are connected to M counter electrodes (M≧2), the (n−1)th selection scan signal, the nth selection scan signal, an alternating current signal and an inverse alternating current signal are inputted in the nth basic circuit (1≦n≦M), there is a difference in phase between said selection scan signal and said alternating current signal, as well as between said selection scan signal and said inverse alternating current signal, and said nth basic circuit supplies a positive or negative counter voltage to the Nth counter electrode on the basis of said inputted (n−1)th selection scan signal, nth selection scan signal, alternating current signal and inverse alternating current signal.

6 Claims, 11 Drawing Sheets

LIQUID CRYSTAL DISPLAY DEVICE

CROSS-REFERENCE TO RELATED APPLICATION

The present application claims priority over Japanese Application JP2010-005903 filed on Jan. 14, 2010, the contents of which are hereby incorporated into this application by reference.

BACKGROUND OF THE INVENTION (1) Field of the Invention

The present invention relates to a liquid crystal display device, and in particular, to a technology which is effective when applied to a common driver for inputting a positive or negative counter voltage in the counter electrode in each pixel.

(2) Description of the Related Art

Liquid crystal display devices using thin film transistors (TFT's) for active elements are widely used as displays for personal computers and the like. These liquid crystal display devices have a liquid crystal display panel, a drive circuit for driving the liquid crystal display panel (a drain driver, a gate driver and a common driver) and a display control circuit (timing controller).

Thin film transistors (TFT's) using an amorphous silicon layer as the semiconductor layer (hereinafter referred to as a-Si thin film transistors) and those using a polysilicon layer as the semiconductor layer (hereinafter referred to as poly-Si thin film transistors) are currently used.

The operation speed of poly-Si thin film transistors is higher than that of a-Si thin film transistors by two digits, and therefore the gate driver and the common driver (which make up the counter electrode driving circuit) are formed of poly-Si thin film transistors in liquid crystal display panels using poly-Si thin film transistors as active elements. The gate driver and the common driver are fabricated on the surface of one of the two substrates that form the liquid crystal panel, on the liquid crystal side.

SUMMARY OF THE INVENTION

As described above, when the gate driver and the common driver are formed of poly-Si thin film transistors on the surface of one of the two substrates that form the liquid crystal panel, on the liquid crystal side, the circuits of the gate driver and the common driver are formed of single channel transistors, and thus the process of manufacture is short, making for efficient production, which is advantageous.

However, conventional common drivers formed of only single channel transistors require thin film transistors for resetting, and the circuit cannot be made smaller, and therefore there is a problem, such that the frame of the liquid crystal display panel cannot be made thinner.

The present invention is provided in order to solve these problems with the prior art, and an object of the present invention is to provide a technology, which makes it possible to make common driver circuits formed only of single channel transistors smaller.

The above described and other objects, as well as novel characteristics of the present invention, will become clearer from the descriptions throughout the present specification, as well as from the accompanying drawings.

The invention of the present application is briefly outlined below.

In order to solve the above described problems, the liquid crystal display device according to the present invention has: a number of pixels; M scan lines for inputting a scan signal in the above described number of pixels ($M \geqq 2$); M counter electrodes for inputting a counter voltage in the above described number of pixels; a scan line driving circuit for supplying a scan signal to the above described M scan lines; and a counter electrode driving circuit for supplying a counter voltage to the above described M counter electrodes, and is characterized in that the above described counter electrode driving circuit has M basic circuits which are respectively connected to the M counter electrodes, the (n−1)th selection scan signal, the nth selection scan signal, an alternating current signal and an inverse alternating current signal are inputted into the nth basic circuit ($1 \leqq n \leqq M$), the above described alternating current signal changes from a first voltage level to a second voltage level after the above described selection scan signal changes from the first voltage level to the second voltage level, and changes from the second voltage level to the first voltage level after the above described selection scan signal changes from the second voltage level to the first voltage level, and the above described inverse alternating current signal changes from a second voltage level to a first voltage level before the above described selection scan signal changes from the first voltage level to the second voltage level, and changes from the first voltage level to the second voltage level after the above described selection scan signal changes from the second voltage level to the first voltage level, or vice-versa, the above described basic circuits have: a first output transistor for supplying a positive counter voltage to the above described nth counter electrode when in an on state; a second output transistor for supplying a negative counter voltage to the above described nth counter electrode when in an on state; a first transistor which turns on when the above described (n−1)th selection scan signal is inputted into the control electrode, takes in the above described alternating current signal and inputs the above described alternating current signal in the control electrode of the first output transistor; a second transistor which turns on when the above described (n−1)th selection scan signal is inputted into the control electrode, takes in the above described inverse alternating current signal and inputs the above described inverse alternating current signal in the control electrode of the second output transistor; a third transistor which turns on when the alternating current signal that is received by the above described first transistor is at the second voltage level and inputs the first reference voltage in the control electrode of the above described second output transistor; a fourth transistor which turns on when the inverse alternating current signal that is received by the above described second transistor is at the second voltage level and inputs the first reference voltage in the control electrode of the above described first output transistor; a fifth transistor of which the control electrode is connected to the control electrode of the above described first output transistor; a sixth transistor of which the control electrode is connected to the control electrode of the above described second output transistor; a first capacitor element that is connected between the control electrode of the above described fifth transistor and the second electrode; a second capacitor element that is connected between the control electrode of the above described sixth transistor and the second electrode; an eighth transistor which turns on when the nth selection scan signal is inputted in the control electrode and inputs the second reference voltage in the first electrode of the above described fifth transistor and the first electrode of the above described sixth transistor.

That is to say, the present invention is characterized in that there is a difference in phase between the selection scan signal and the alternating current signal, as well as between the selection scan signal and the inverse alternating current signal, in a divided counter electrode driving system, in which counter electrodes in the pixels are divided so as to correspond to display lines and driven by counter electrode driving circuits provided for each display line.

Thus, a dedicated signal for resetting becomes unnecessary and it is possible to omit thin film transistors for resetting, and therefore it is possible to reduce the area required for the counter electrode driving circuit.

According to the present invention, it is possible to make common driver circuits formed of only single channel transistors smaller.

DESCRIPTION OF THE EMBODIMENTS

Figure 1:
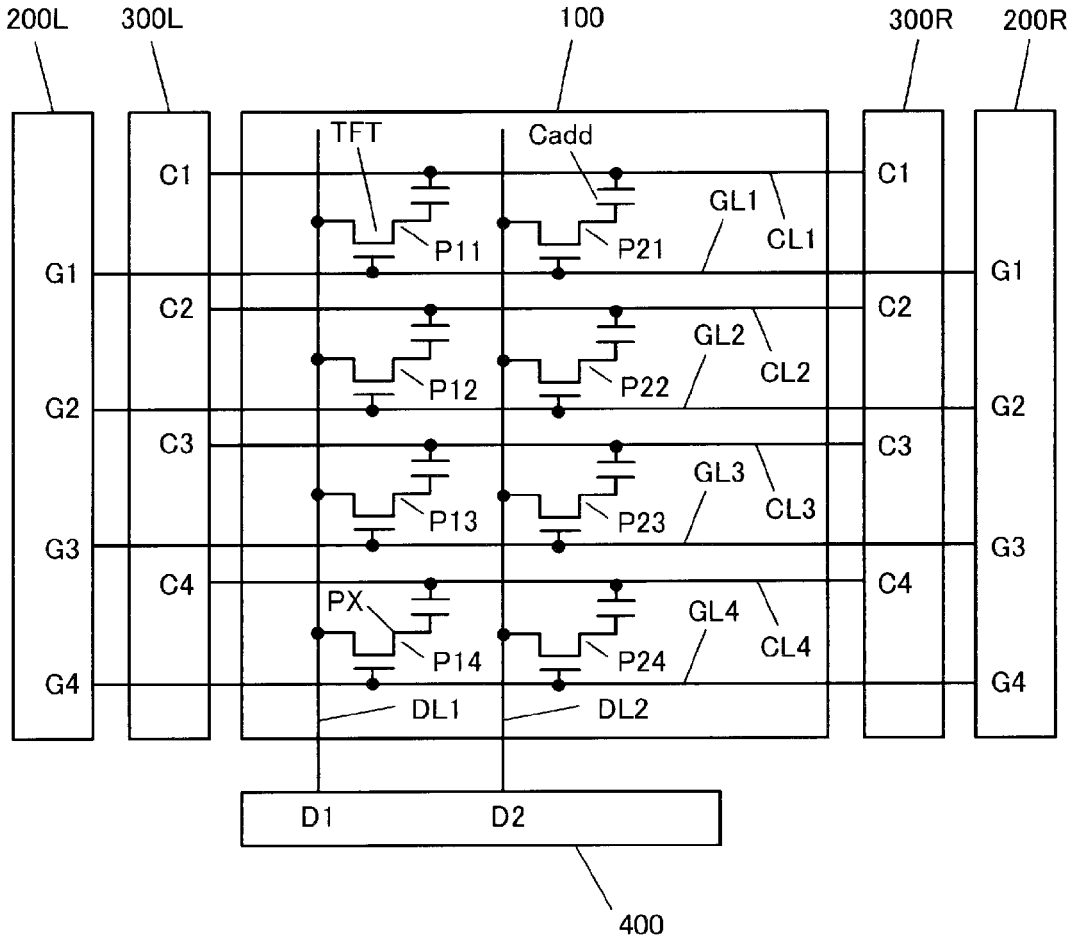
FIG. 1 is a block diagram schematically showing the structure of the liquid crystal display device according to one embodiment of the present invention.

In the following the embodiments of the present invention are described in detail in reference to the drawings.

In the drawings showing embodiments, the same symbols are used for components having the same function, and descriptions that are the same are not repeated. In addition, the following embodiments are not meant to limit the interpretation of the scope of the claims.

First Embodiment

FIG. 1 is a block diagram schematically showing the structure of the liquid crystal display device according to the first embodiment of the present invention.

As shown in FIG. 1, the liquid crystal display device according to this embodiment is provided with a display portion 100, gate drivers 200L and 200R, common drivers 300L and 300R, and a drain driver 400.

The display portion 100 has a number of scan lines (also referred to as gate lines) GL and a number of video lines (also referred to as source lines, or drain lines) DL on the liquid crystal side of one of a pair of substrates that are positioned so as to face each other with liquid crystal in between.

Regions between two adjacent scan lines and video lines are sub-pixels. Each sub-pixel is provided with a thin film transistor TFT (active element) of which the gate is connected to one of the scan lines, of which the drain is connected to one of the video lines and the source to a pixel electrode PX, or vice-versa.

In the liquid crystal display device of the present embodiment, poly-Si thin film transistors are used as active elements, as are the gate drivers and common drivers are formed of poly-Si thin film transistors, and the gate drivers and common drivers are fabricated on the liquid crystal side of one of the pair of substrates forming the liquid crystal display panel.

A capacitor Cadd is provided between each pixel electrode PX and counter electrode CL. There is liquid crystal between the pixel electrode PX and the counter electrode CL.

Scan lines GL are connected to the gate drivers 200L and 200R formed on either side of the display portion 100, and the gate drivers 200L and 200R supply a selective scan signal to the scan lines GL for the display lines from the two sides (left and right) in sequence.

In the present embodiment there is a common electrode CL for each display line. Each counter electrode CL is connected to the common drivers 300L and 300R formed on either side of the display portion 100, so that the common drivers 300L and 300R supply a positive counter voltage or negative counter voltage to the counter electrodes CL in each display line from the two sides (left and right).

Each video line DL is connected to the drain driver 400. The drain driver 400 outputs video voltages R, G and B (so-called gradation voltage) to a video line DL within one horizontal scanning period.

The liquid crystal display device of the present embodiment is formed of a first substrate having pixel electrodes and thin film transistors (also referred to as TFT substrate, or active matrix substrate), not shown, and a second substrate having color filters (also referred to as facing substrate), also not shown. The first and second substrate precisely overlap with a predetermined space in between and pasted together through a sealing material frame along the outer edges, and liquid crystal is injected between the two substrates within the sealing material frame through an inlet provided in the sealing material, which is then closed, and furthermore polarizing plates are pasted on the surface of the two substrates.

Thus, the liquid crystal display device of the present embodiment has such a structure that liquid crystal is sandwiched between a pair of substrates. In addition, counter electrodes are provided on the second substrate (facing substrate) side when the liquid crystal display panel is of a TN type or VA type. In the case of an IPS type they are provided on the first substrate (TFT substrate) side.

The present invention does not relate to the internal structure of the liquid crystal display panel, and therefore the detailed description thereof is omitted. Furthermore, the present invention can be applied to any liquid crystal display panel.

Figure 2:
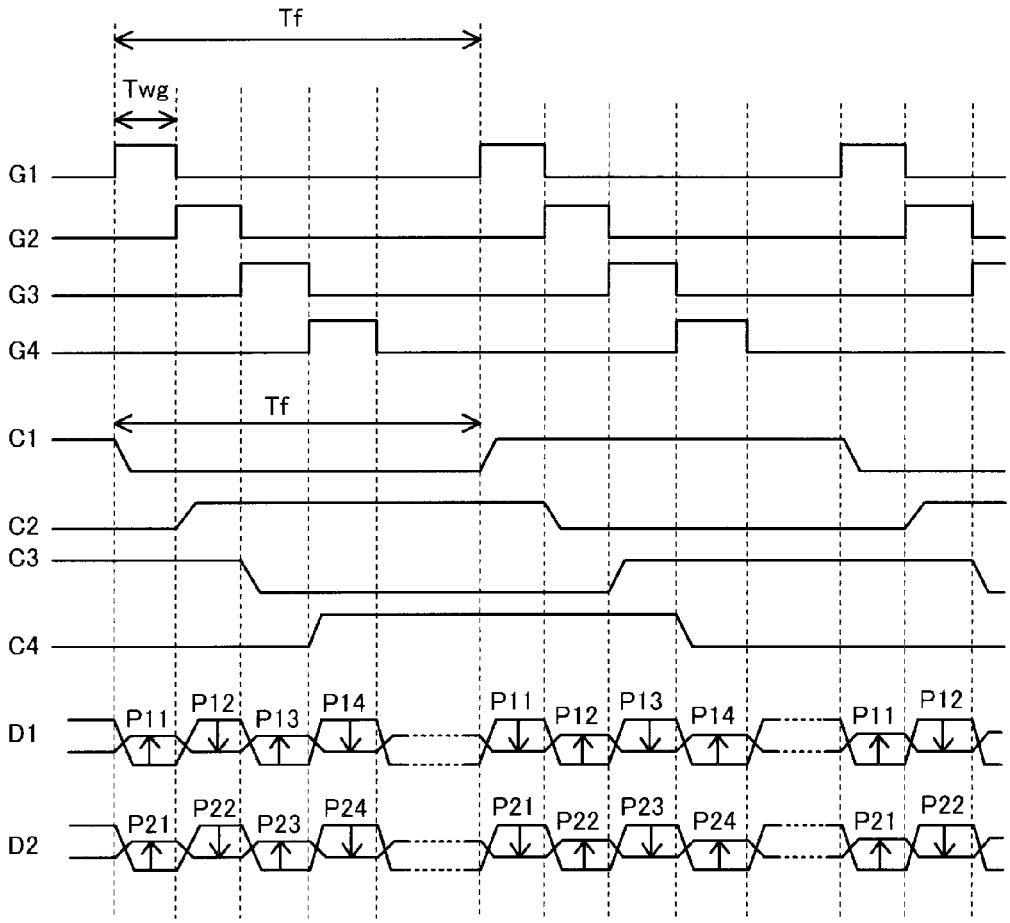
FIG. 2 is a timing chart illustrating the operation of the liquid crystal display device according to the same embodiment of the present invention.

FIG. 2 is a timing chart illustrating the operation of the liquid crystal display device of the present embodiment. This chart is for the case of a line by line alternating driving method where the polarity of the video voltage that is written into the pixels alternates line by line.

Selection scan signals G1 to G4 repeat with a period of one frame (Tf), so that each successive horizontal period (Twg) has the high level (hereinafter referred to as H level) in the next higher scan signal.

The counter voltages C1 to C4 invert in voltage level at the point in time when the corresponding selection scan signal rises, and provide signals with two-frame periods. The polarity of the inverted voltage is different between odd lines and even lines in the counter electrodes (CL).

The video voltages D1 and D2 have the counter voltages as a reference. The video voltages D1 and D2 correspond to the pixels P11 to P14 and P21 to P24, respectively, and their polarities invert every horizontal period (Twg).

In FIG. 2 ↑ signifies that a positive video voltage is written into each pixel (voltage of pixel electrode>counter voltage) and ↓ signifies that a negative video voltage is written into each pixel (voltage of pixel electrode<counter voltage).

As shown in FIG. 2, in the line by line alternating driving method the polarity of the video voltage written into each pixel alternates every display line, and the polarity of the video voltage written into each pixel alternates every frame.

That is to say, in the case where a positive video voltage is written into pixels in odd display lines and a negative video voltage is written into pixels in even display lines in one frame, a negative video voltage is written into the pixels in the odd display lines and a positive video voltage is written into the pixels in the even display lines in the next frame.

Conventional common drivers 300L and 300R have M basic circuits for M counter electrodes (M≧2).

Figure 3:
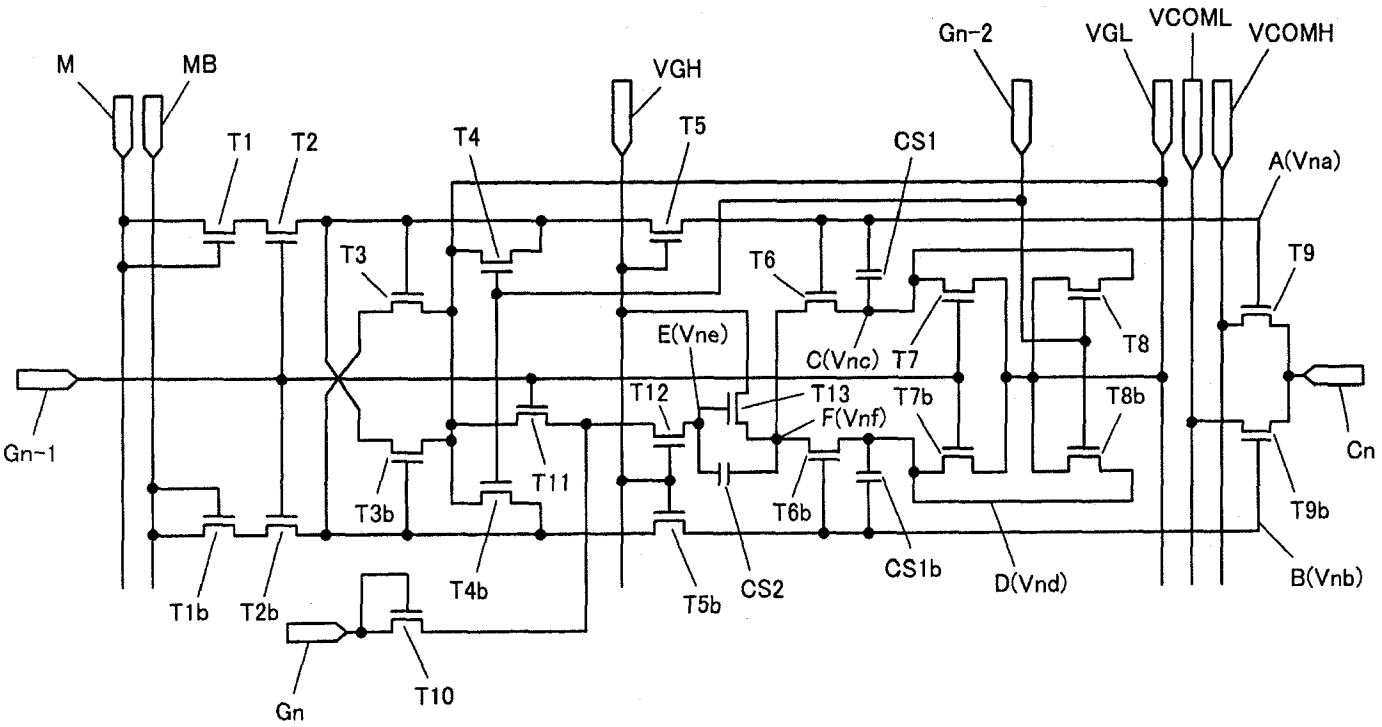
FIG.3 (Prior Art)
FIG. 3 is a circuit diagram showing the structure of the nth basic circuit in a conventional common driver ($1 \leqq n \leqq M$)

FIG. 3 is a circuit diagram showing the structure of the nth basic circuit of conventional common drivers 300L and 300R (1≦n≦M).

In FIG. 3 Gn−2 Gn−1 and Gn are the (n−2)th, (n−1)th and nth selection scan signals outputted from the gate drivers 200L and 200R. In addition, Cn is a counter voltage outputted from the nth basic circuit, M is an alternating current signal, and MB is the inverse alternating current signal.

In addition, VGL is a voltage of an unselected scan signal outputted from the gate drivers 200L and 200R, and VGH is a voltage of a selection scan signal outputted from the gate drivers 200L and 200R. Furthermore, VCOML is a negative counter voltage and VCOMH is a positive counter voltage.

The circuit shown in FIG. 3 is formed of thin film transistors T1 to T13, thin film transistors T1*b* to T9*b*, and capacitor elements CS1, CS2 and CS1*b*. The thin film transistors T1 to T9 and the capacitor element CS1 form a circuit for outputting a positive counter voltage VCOMH to the nth counter electrode CL when the alternating current signal M is at the H level, and the thin film transistors T1*b* to T9*b* and the capacitor element CS1*b* form a circuit for outputting a negative counter voltage VCOML to the nth counter electrode CL when the inverse alternating current signal MB is at the H level. The thin film transistors Tn to T13 and the capacitor element CS2 form a circuit for boosting the gate voltage of the output transistors T9 and T9*b*.

Figure 4:
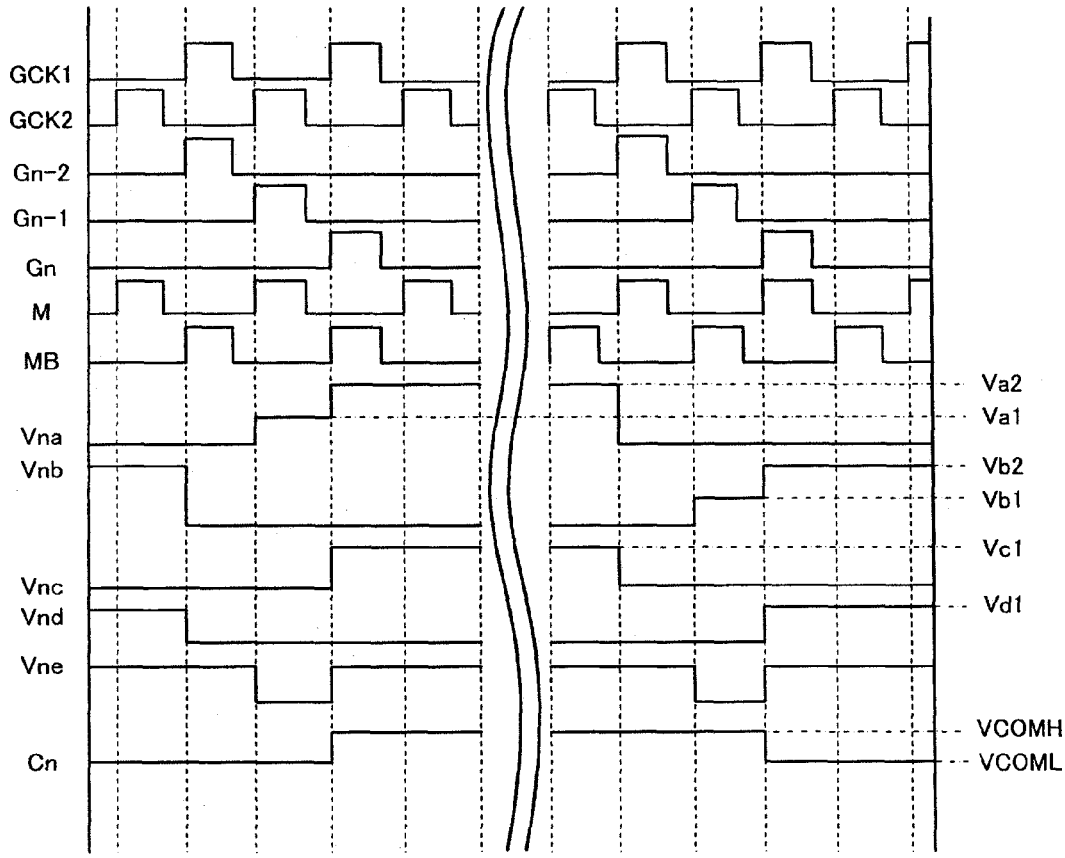
FIG.4 (Prior Art)
FIG. 4 is a timing chart illustrating the operation of the basic circuit in FIG. 3.

FIG. 4 is a timing chart illustrating the operation of the basic circuit in FIG. 3. The timing chart in FIG. 4 shows two successive frames in a case where there is no difference in phase between the shift clocks GCK1 and GCK2 and the alternating current signal M and the shift clocks GCK1 and GCK2 and the inverse alternating current signal MB.

In the basic circuit shown in FIG. 3, the thin film transistors T4 and T4*b* reset the voltage at the node A (Vna) and the voltage at the node B (Vnb) to the voltage VGL during the period when the (Gn−2)th selection scan signal is at the H level, and at the same time the thin film transistors T8 and T8*gb* reset the voltage at the node C (Vnc) and the voltage at the node D (Vnd) to the voltage VGL.

In addition, the alternating current signal M or the inverse alternating current signal MB is taken in during the period when the (Gn−1)th selection scan signal is at the H level, and the gate voltage (Vna or Vnb of the thin film transistors T9 and T9*b*, which are output transistors rises.

First the operation in the first frame is described.

(1) Period During which (Gn−2)Th Selection Scan Signal is at H Level

As described above, during the period when the (Gn−2)th selection scan signal is at the H level, the thin film transistors T4 and T4*b* are turned on, so that the voltage at the node A (Vna) and the voltage at the node B (Vnb) is reset to the voltage VGL via the thin film transistors T5 and T5*b*, where the voltage VGH is inputted into the gate, and at the same time the thin film transistors T8 and T8*b* are turned on, so that the voltage at the node C (Vnc) and the voltage at the node D (Vnd) is reset to the voltage VGL.

(2) Period During which (Gn−1)Th Selection Scan Signal is at H Level

During the period during which the (Gn−1)th selection scan signal is at the H level, the thin film transistors T2 and T2*b* are turned on when the alternating signal current M is at the H level and the inverse alternating current signal MB is at the low level (hereinafter referred to as L level), and therefore an alternating current signal M is taken in via the thin film transistors T1 and T2, which are diode connected, and supplied to the node A via the thin film transistor T5, and thus the voltage at the node A (Vna) changes to the voltage Va1.

In addition, the thin film transistor T3, of which the gate is connected to the second electrode (drain or source) of the thin film transistor T2 is turned on, so that the voltage VGL is supplied to the second electrode of the thin film transistor T2*b* and supplied to the node B via the thin film transistor T5*b*, and thus the voltage at the node B (Vnb) maintains the voltage VGL.

During this period, the thin film transistors T7 and T7*b* are turned on, so that the voltage at the node C (Vnc) and the voltage at the node D (Vnd) remains VGL. Furthermore, the thin film transistor T11 is turned on, so that the voltage at the node E (Vne) is reset to the voltage VGL via the thin film transistor T12, where the voltage VGH is inputted into the gate.

(3) Period During which Gnth Selection Scan Signal is at H Level

During the period during which the Gnth selection scan signal is at the H level, The thin film transistor T3 is turned on and the thin film transistor T3*b* turned off. In this state the Gnth selection scan signal is inputted into the first electrode (source or drain) of the thin film transistor T12 via the thin film transistor T10, which is diode connected, so that the thin film transistor T13 is turned on and the voltage at the node F (Vnf) rises. Here, the voltage at the node F (Vnf) is approximately the VGH, due to the bootstrap effects of the capacitor element CS2.

In addition, during the period during which the (Gn−1)th selection scan signal is at the H level, the voltage at the node A (Vna) changes to the voltage Va1, so that the thin film transistor T6 is turned on. In this state the voltage at the node F (Vnf) becomes approximately VGH, so that the voltage at the node C (Vnc) becomes Vc1, and furthermore the voltage at the node A (Vna) becomes Va2, which is no lower than VGH, due to the bootstrap effects of the capacitor element CS1. As a result the thin film transistor T9 is turned on, so that a positive counter voltage VCOMH is outputted to the nth counter electrode CL.

In addition, during the period during which the (Gn−1)th selection scan signal is at the H level, the voltage at the node B (Vnb) remains VGL, and therefore the thin film transistor T6*b* is turned off. Even when the voltage at the node F (Vnf) becomes approximately VGH in this state, the voltage at the node B (Vnb) is VGL. Accordingly, the thin film transistor T9*b* remains off.

Next, the operation in the second frame is described.

(1) Period During which (Gn−2)Th Selection Scan Signal is at H Level

As described above, during the period during which the (Gn−2)th selection scan signal is at the H level, the thin film transistors T4 and T4*b* are turned on, so that the voltage at the node A (Vna) and the voltage at the node B (Vnb) are reset to the voltage VGL via the thin film transistors T5 and T5*b*, and at the same time, the thin film transistors T8 and T8*b* are turned on, so that the voltage at the node C (Vnc) and the voltage at the node D (Vnd) are reset to the voltage VGL.

(2) Period During which (Gn−1)Th Selection Scan Signal is at H Level

During the period during which the (Gn−1)th selection scan signal is at the H level, the thin film transistors T2 and T2*b* are turned on, and the alternating current signal M is at the L level and the inverse alternating current signal MB is at the H level, and therefore the inverse alternating current signal MB is taken in via the thin film transistors T1*b* and T2*b*, which are diode connected, and supplied to the node B via the thin film transistor T5*b*, so that the voltage at the node B (Vnb) changes to the voltage Vb1.

In addition, the tin film transistor T3*b* of which the gate is connected to the second electrode of the thin film transistor T2*b* is turned on, so that the voltage VGL is supplied to the second electrode of the thin film transistor T2, and supplied to the node A via the thin film transistor T5, and therefore the voltage at the node A (Vna) remains VGL.

In addition, the thin film transistors T7 and T7*b* are turned on, so that the voltage at the node C (Vnc) and the voltage at the node D (Vnd) remain VGL. Furthermore, the thin film transistor T11 is turned on, so that the voltage at the node E (Vne) is reset to the voltage VGL via the thin film transistor T12.

(3) Period During which Gnth Selection Scan Signal is at H Level

During the period during which the Gnth selection scan signal is at the H level, the thin film transistor T3 is turned off and the thin film transistor T3*b* is turned on. In this state the Gnth selection scan signal is inputted into the first electrode of the thin film transistor T12 via the thin film transistor T10, which is diode connected, so that the thin film transistor T13 is turned on and the voltage at the node F (Vnf) rises. Here, the voltage at the node F (Vnf) becomes approximately VGH, due to the bootstrap effects of the capacitor element CS2.

In addition, during the period during which the (Gn−1)th selection scan signal is at the H level, the voltage at the node A (Vna) remains VGL, and therefore the thin film transistor T6 is turned off. In this state, even when the voltage at the node F (Vnf) becomes approximately VGH, the voltage at the node A (Vna) remains VGL. Accordingly, the thin film transistor T9 remains off.

In addition, during the period during which the (Gn−1)th selection scan signal is at the H level, the voltage at the node B (Vnb) changes to the voltage VD1, so that the thin film transistor T6*b* is turned on. In this state the voltage at the node F (Vnf) becomes approximately the voltage VGH, so that the voltage at the node B (Vnb) becomes the voltage Vd1, and furthermore the voltage at the node B (Vnb) becomes the voltage Vb2, which is no lower than the voltage VGH, due to the bootstrap effects of the capacitor element CS1*b*. As a result, the thin film transistor T9*b* is turned on, so that a negative counter voltage VCOML is outputted to the nth counter electrode CL.

As described above, there is no difference in phase between the shift clocks GCK1 and GCK2; in other words, between selection scan signals and the alternating current signal M, nor between the shift clocks GCK1 and GCK2 and the inverse alternating current signal MB, in conventional common drivers 300L and 300R, and therefore the basic circuit for the conventional common drivers 300L and 300R requires the thin film transistors T4 and T4*b*, as well as T8 and T8*b*, in order to reset the voltage at the nodes A to D (Vna to Vnd) to VGL during the period during which the (Gn−2)th selection scan signal is at the H level.

In addition, when the alternating current signal M or the inverse alternating current signal MB falls before the shift clocks GCK1 and GCK2, the voltage at the node A (Vna) and the voltage at the node B (Vnb) become of the L level. In order to prevent this, thin film transistors T1 and T1*b* are required to take in the alternating current signal M and the inverse alternating current signal MB.

Thus, there is a problem with the basic circuit for conventional common drivers 300L and 300R, such that the circuit area cannot be made smaller.

Figure 5:
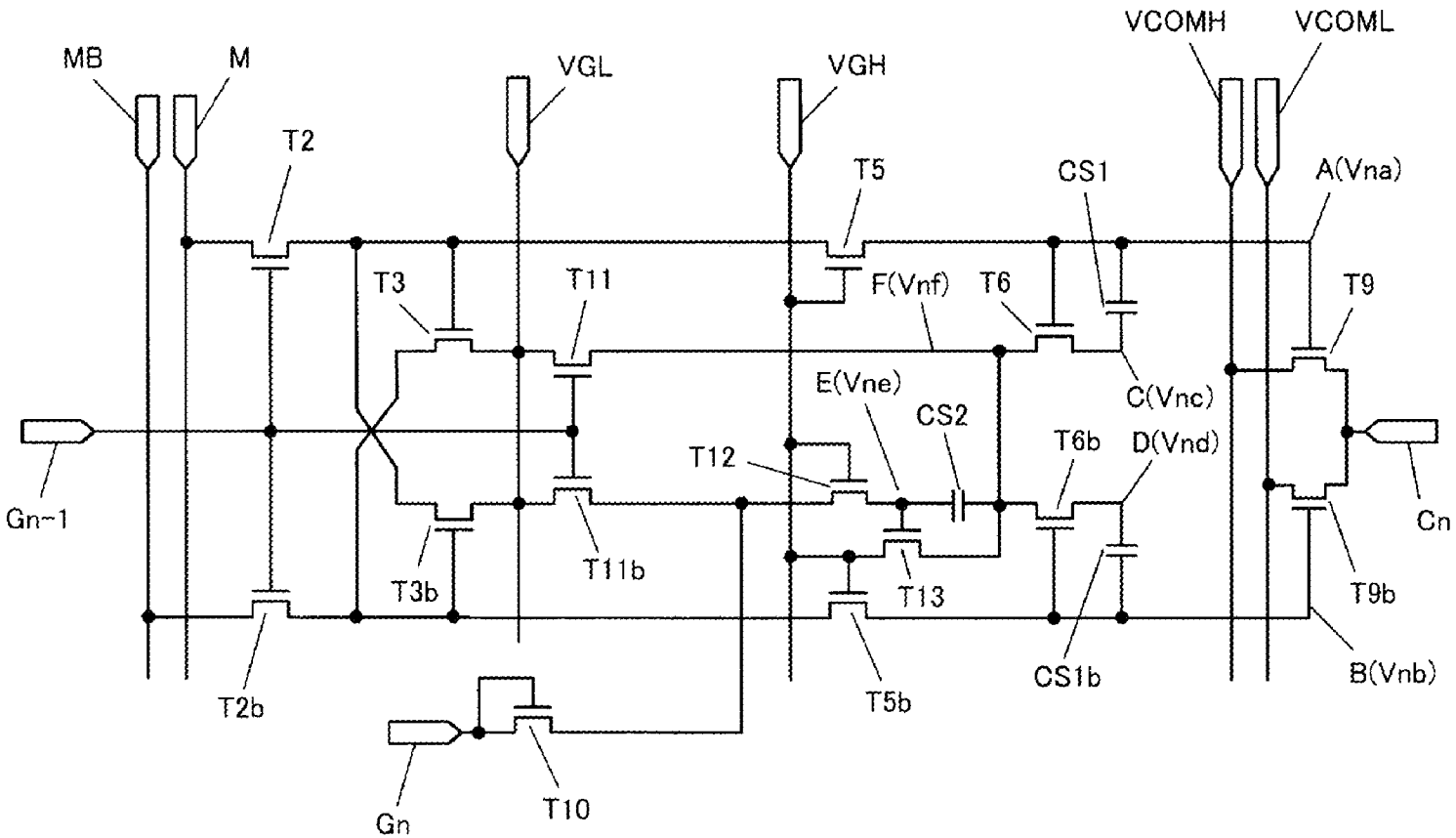
FIG. 5 is a circuit diagram showing the structure of the nth basic circuit in the common driver according to the first embodiment of the present invention ($1 \leqq n \leqq M$)

FIG. 5 is a circuit diagram showing the structure of the nth basic circuit of the common drivers 300L and 300R according to the first embodiment of the present invention ($1 \leqq n \leqq M$).

Unlike the conventional circuit in FIG. 3, this basic circuit does not have thin film transistors T1 and T1*b* for taking in the alternating current signal M and the inverse alternating current signal MB, nor the thin film transistors T4, T4*b*, T8 and T8*b*, for resetting the voltage at the nodes A to C (Vna to Vnd) to the voltage VGL.

Figure 6:
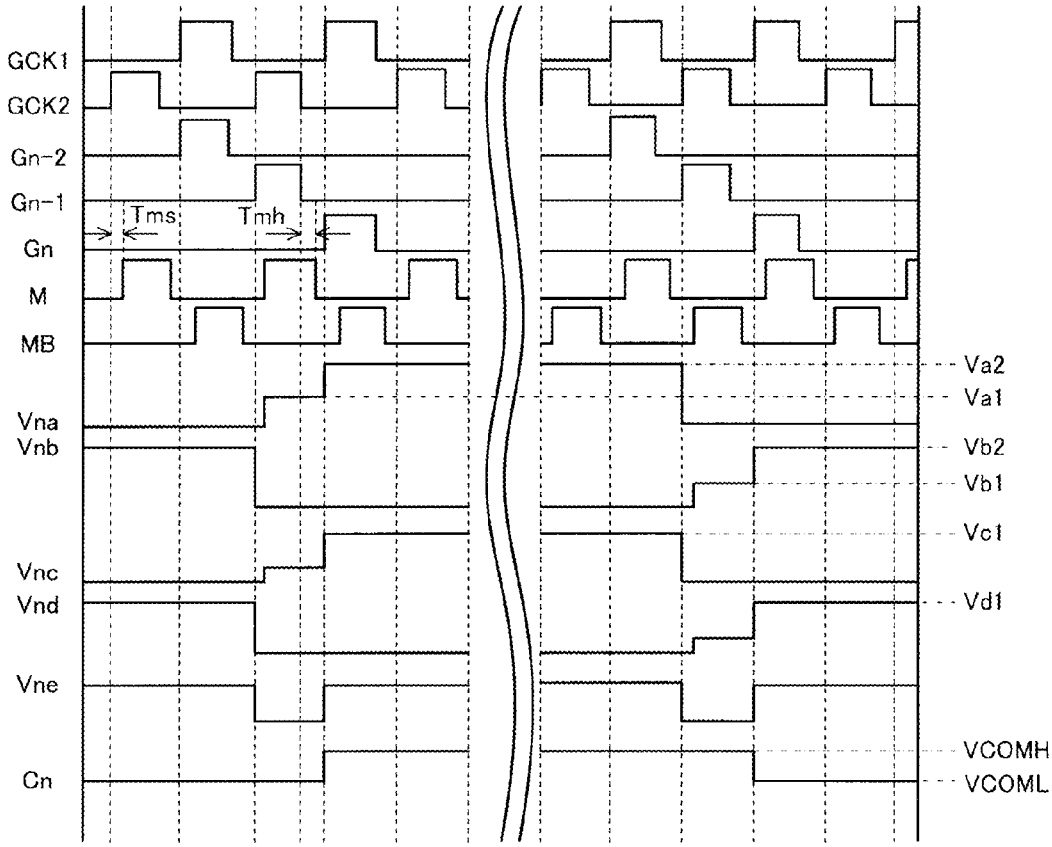
FIG. 6 is a timing chart illustrating the operation of the basic circuit in FIG. 5.

FIG. 6 is a timing chart illustrating the operation of the basic circuit in FIG. 5.

This chart is different from that in FIG. 4 in that there is a difference in phase at the point in time when the voltage rises and falls (Tms and Tmh) between the shift clocks GCK1 and GCK2 and the alternating current signal M, as well as between the shift clocks GCK1 and GCK2 and the inverse alternating current signal MB.

In the following the operation in the first frame in the basic circuit of the present embodiment is described.

(1) Period During which (Gn−1)Th Selection Scan Signal is at H Level

During the period during which the (Gn−1)th selection scan signal is at the H level, the thin film transistors T2 and T2*b* are turned on. In addition, during the period Tms during which the (Gn−1)th selection scan signal is at the H level, the alternating current signal M and the inverse alternating current signal MB are the voltage VGL, which is at the H level, and therefore, during the period Tms the voltage at the node A (Vna) is reset to VGL via the thin film transistor T5, where the voltage VGH is inputted into the gate, and at the same time the voltage at the node B (Vnb) is reset to VGL via the thin film transistor T5*b*, where the voltage VGH is inputted into the gate.

In addition, during the period during which the (Gn−1)th selection scan signal is at the H level, the thin film transistors T11 and T11*b* are turned on, and therefore the voltage at the node F (Vnf) is reset to the voltage VGL, and at the same time the voltage at the node E (Vne) is reset to the voltage VGL via the thin film transistor T12, where the voltage VGH is inputted into the gate.

Next, when the alternating current signal M is at the H level and the inverse alternating current signal MB is at the L level after the period Tms, the alternating current signal M is taken in by the thin film transistor T2 and supplied to the node A via the thin film transistor T5, so that the voltage at the node A (Vna) changes to the voltage Va1. In addition, when the alternating current signal M is at the H level, the thin film transistor T3 is turned on, so that the voltage VGL is supplied to the second electrode of the thin film transistor T2*b* and supplied to the node B via the thin film transistor T5*b*, and therefore the voltage at the node B (Vnb) remains VGL.

(2) Period During which Gnth Selection Scan Signal is at H Level

During the period during which the Gnth selection scan signal is at the H level, the thin film transistor T3 is turned on and the thin film transistor T3*b* turned off. In this state the Gnth selection scan signal is inputted into the first electrode of the thin film transistor T12, where the voltage VGH is inputted into the gate, via the thin film transistor T10, which is diode connected, so that the thin film transistor T13 is turned on and the voltage at the node F (Vnf) rises. Here, the voltage at the node F (Vnf) becomes approximately VGH, due to the bootstrap effects of the capacitor element CS2.

In addition, during the period during which the (Gn−1)th selection scan signal is at the H level, the voltage at the node A (Vna) changes to the voltage Va1, so that the thin film transistor T6 is turned on, and the voltage at the node C (Vnc) is reset to VGL via the thin film transistor T11 (see FIG. 6). In this state the voltage at the node F (Vnf) becomes approximately VGH, so that the voltage at the node C (Vnc) becomes the voltage Vc1, and furthermore the voltage at the node A (Vna) becomes the voltage Va2, which is no lower than the voltage VGH, due to the bootstrap effects of the capacitor elements CS1. As a result the thin film transistor T9 is turned on, and a positive counter voltage VCOMH is outputted to the nth counter electrode CL.

In addition, during the period during which the (Gn−1)th selection scan signal is at the H level, the voltage at the node B (Vnb) remains VGL, so that the thin film transistor T6*b* is turned off. In this state, even when the voltage at the node F (Vnf) becomes approximately VGH, the voltage at the node B (Vnb) remains VGL. Accordingly, the thin film transistor T9*b* is turned off.

Next, the operation in the second frame is described.

(1) Period During which (Gn−1)Th Selection Scan Signal is at H Level

During the period during which the (Gn−1)th selection scan signal is at the H level, the thin film transistors T2 and T2*b* are turned on. In addition, during the period Tms during which the (Gn−1)th selection scan signal is at the H level, the alternating current signal M and the inverse alternating current signal MB are the voltage VGL, which is at the L level, and therefore, during the period Tms the voltage at the node A (Vna) and the voltage at the node B (Vnb) are reset to the voltage VGL via the thin film transistors T5 and T5B.

In addition, during the period during which the (Gn−1)th selection scan signal is at the H level, the thin film transistors T11 and T11*b* are turned on, so that the voltage at the node F (Vnf) is reset to VGL, and at the same time the voltage at the node E (Vne) is reset to VGL via the thin film transistor T12.

Next, when the alternating current signal M is at the L level and the inverse alternating current signal MB is at the H level after the period Tms, the inverse alternating current signal MB is taken in by the thin film transistor T2*b* and supplied to the node B via the thin film transistor T5*b*, so that the voltage at the node B (Vnb) changes to the voltage Vb1. In addition, when the inverse alternating current signal MB is at the H level, the thin film transistor T3*b* is turned on and the voltage VGL is supplied to the second electrode of the thin film transistor T2 and the node A via the thin film transistor T5, so that the voltage at the node A (Vna) remains VGL.

(2) Period During which Gnth Selection Scan Signal is at H Level

During the period during which the Gnth selection scan signal is at the H level, the thin film transistor T3 is turned off and the thin film transistor T3*b* turned on. In this state the Gnth selection scan signal is inputted into the first electrode of the thin film transistor T12 via the thin film transistor T10, which is diode connected, so that the thin film transistor T13 is turned on and the voltage at the node F (Vnf) rises. Here, the voltage at the node F (Vnf) becomes approximately the voltage VGH, due to the bootstrap effects of the capacitor element CS2.

In addition, during the period during which the (Gn−1)th selection scan signal is at the H level, the voltage at the node B (Vnb) changes to the voltage Vb1, so that the thin film transistor T6*b* is turned on, and the voltage at the node D (Vnb) is reset to VGL via the thin film transistor T11 (see FIG. 6). In this state the voltage at the node F (Vnf) becomes approximately the voltage VGH, so that the voltage at the node D (Vnd) becomes the voltage Vd1, and furthermore the voltage at the node B (Vnb) becomes the voltage Vb2, which is no lower than the voltage VGH, due to the bootstrap effects of the capacitor element CS1*b*. As a result, the thin film transistor T9*b* is turned on and a negative counter voltage VCOML is outputted to the nth counter electrode CL.

In addition, during the period during which the (Gn−1)th selection scan signal is at the H level, the voltage at the node A (Vna) remains VGL, and therefore the thin film transistor T6 is turned off. In this state, even when the voltage at the node F (Vnf) becomes approximately the voltage VGH, the voltage at the node A (Vna) remains VGL. Accordingly, the thin film transistor T9 remains off.

Here, the thin film transistor T5 prevents the voltage of the second electrode of the thin film transistor T2 from exceeding VGH−Vth (Vth is the threshold voltage of the thin film transistor T5) in the case where the voltage at the node A (Vna) becomes the voltage Vat, which is no lower than the voltage VGH, and thus is not absolutely necessary. This is the same for the thin film transistors T5*b* and T12.

In the case where there is a difference in shift between the shift clocks GCK1 and GCK2 (Tms and Tmh); in other words, between selection scan signals and the alternating current signal M, as well as between the shift clocks GCK1 and GCK2, and the inverse alternating current signal MB, as in the present embodiment, thin film transistors for taking in the alternating current signal M and the inverse alternating current signal MB (T1 and T1*b* in FIG. 3), and thin film transistors for resetting the voltage at the nodes A to D (Vna to Vnd) to the voltage VGL (T4, T4*b*, T8 and T8*b* in FIG. 3) are not necessary, and thus it becomes possible to make the circuit area smaller.

Figure 9:
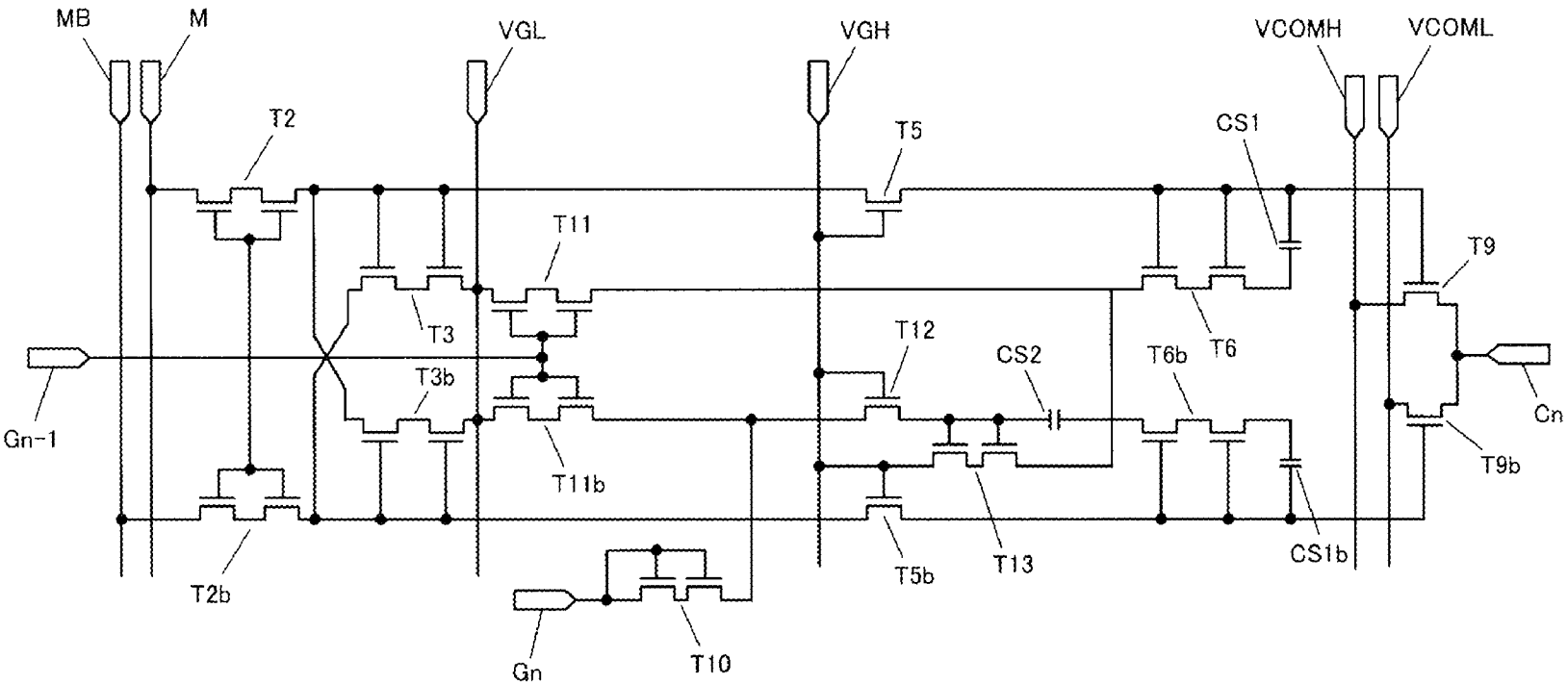
FIG. 9 is a circuit diagram showing the structure of a common driver circuit to which the basic circuit according to the first embodiment of the present invention is applied.

FIG. 9 shows the circuit when the basic circuit in FIG. 5 is applied to a common driver.

The basic circuit in FIG. 9 is different from the basic circuit in FIG. 5 in that the thin film transistors T2, T2*b*, T3, T3*b*, T6, T6*b*, T11, T11*b* and T13 in FIG. 5 are each formed of two thin film transistors that are connected in series with the same voltage inputted into the gates, and the thin film transistor T10 in FIG. 5 is formed of two thin film transistors that are connected in series, where the Gnth selection scan signal is inputted into the gates.

As shown in FIG. 9, the circuit can be formed of pairs of thin film transistors that are connected in series with the same voltage inputted into the gates so that the leak current can be reduced.

Second Embodiment

Figure 7:
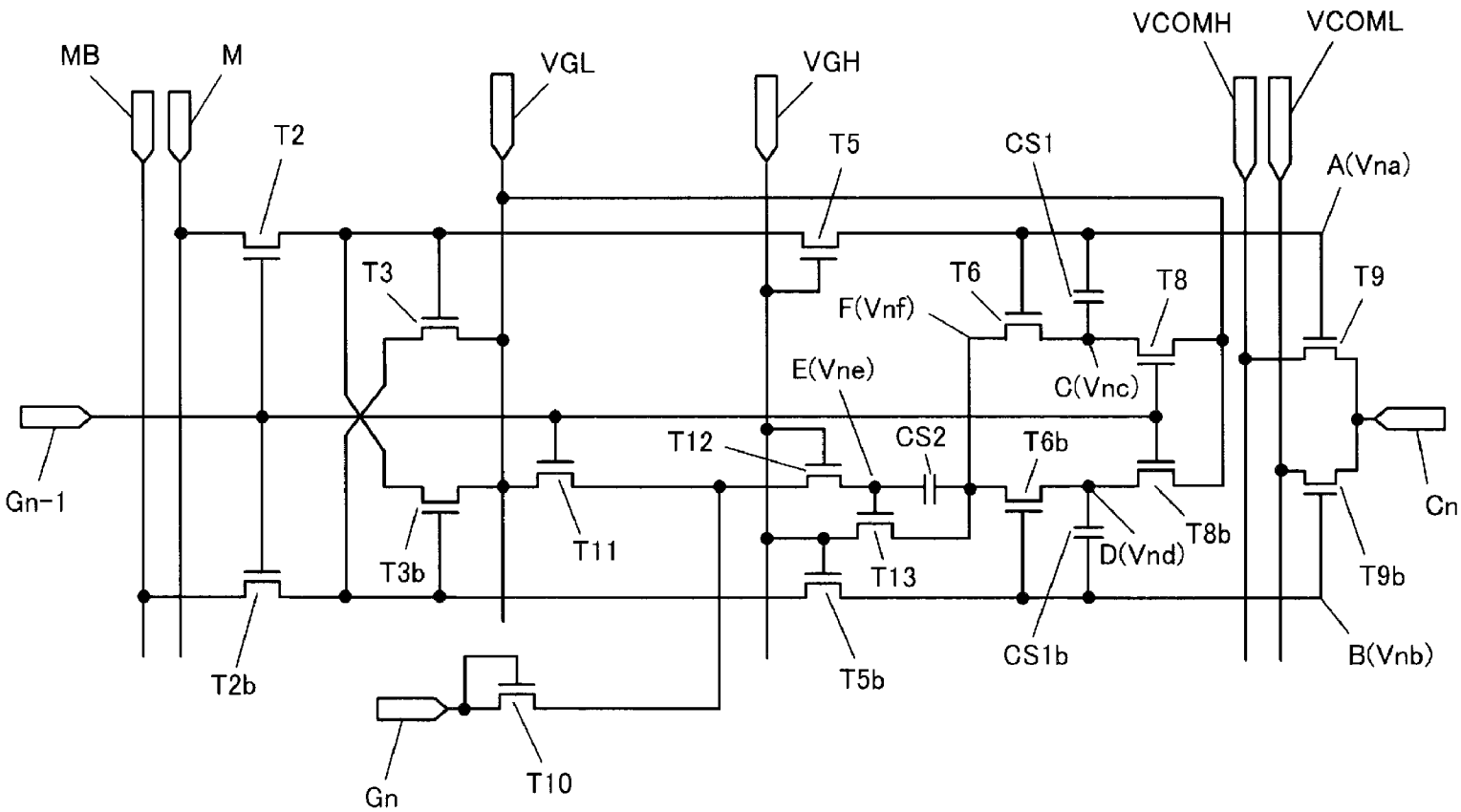
FIG. 7 is a circuit diagram showing the structure of the nth basic circuit in the common driver according to the second embodiment of the present invention ($1 \leqq n \leqq M$)

FIG. 7 is a circuit diagram showing the structure of the nth basic circuit for the common drivers 300L and 300R according to the second embodiment of the present invention (1≦n≦M).

This circuit is different from the circuit in FIG. 5 in that it has thin film transistors T8 and T8*b* for resetting the voltage at the node C (Vnc) and the voltage at the node D (Vnd) to the voltage VGL.

These thin film transistors T8 and T8*b* are provided in order to prevent the voltage at the node C (Vnc) and the voltage at the node D (Vnd) from becoming lower than the voltage VGL.

Figure 8:
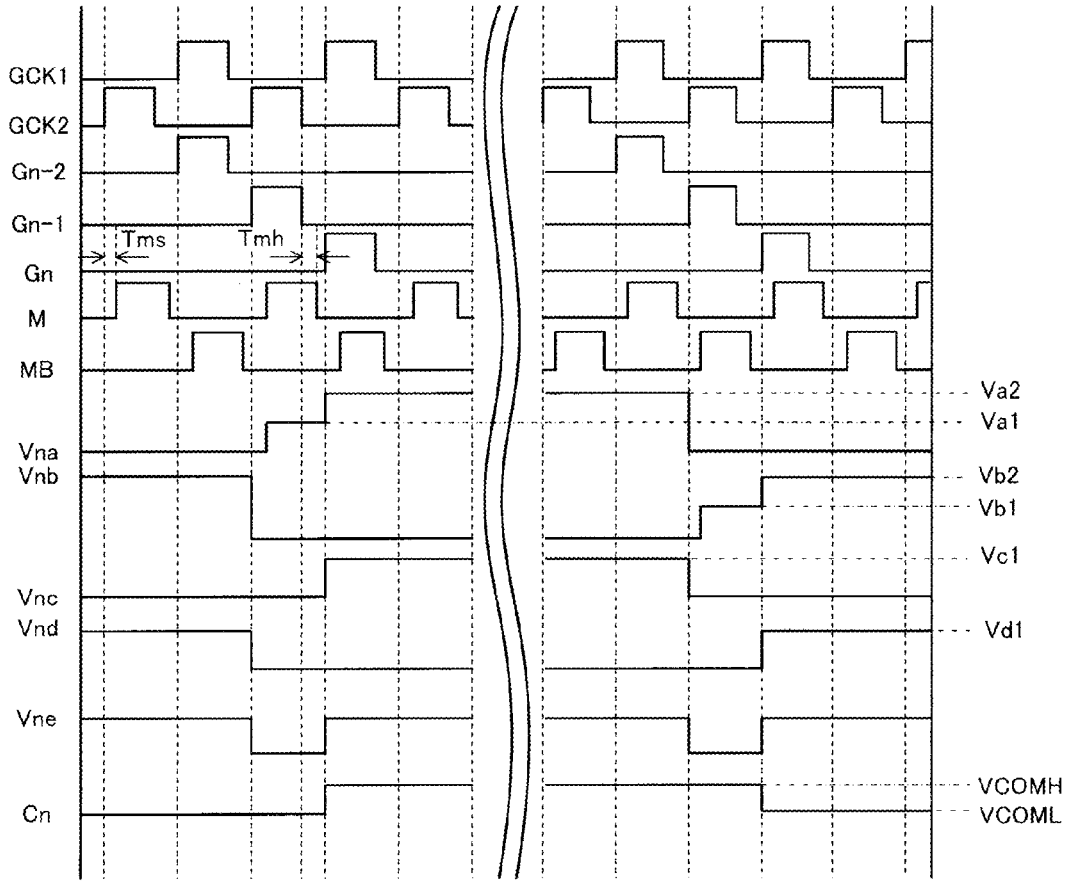
FIG. 8 is a timing chart for illustrating the operation of the basic circuit in FIG. 7.

FIG. 8 is a timing chart illustrating the operation of the basic circuit in FIG. 7. The timing chart in FIG. 8 is the same as the timing chart in FIG. 6, except that the voltage at the node C (Vnc) immediately becomes the voltage Vc1 and the voltage at the node D (Vnd) immediately becomes the voltage Vd1 at the point in time when the (G−1)th selection scan signal becomes of the H level. Thus, descriptions that are the same are not repeated.

Figure 10:
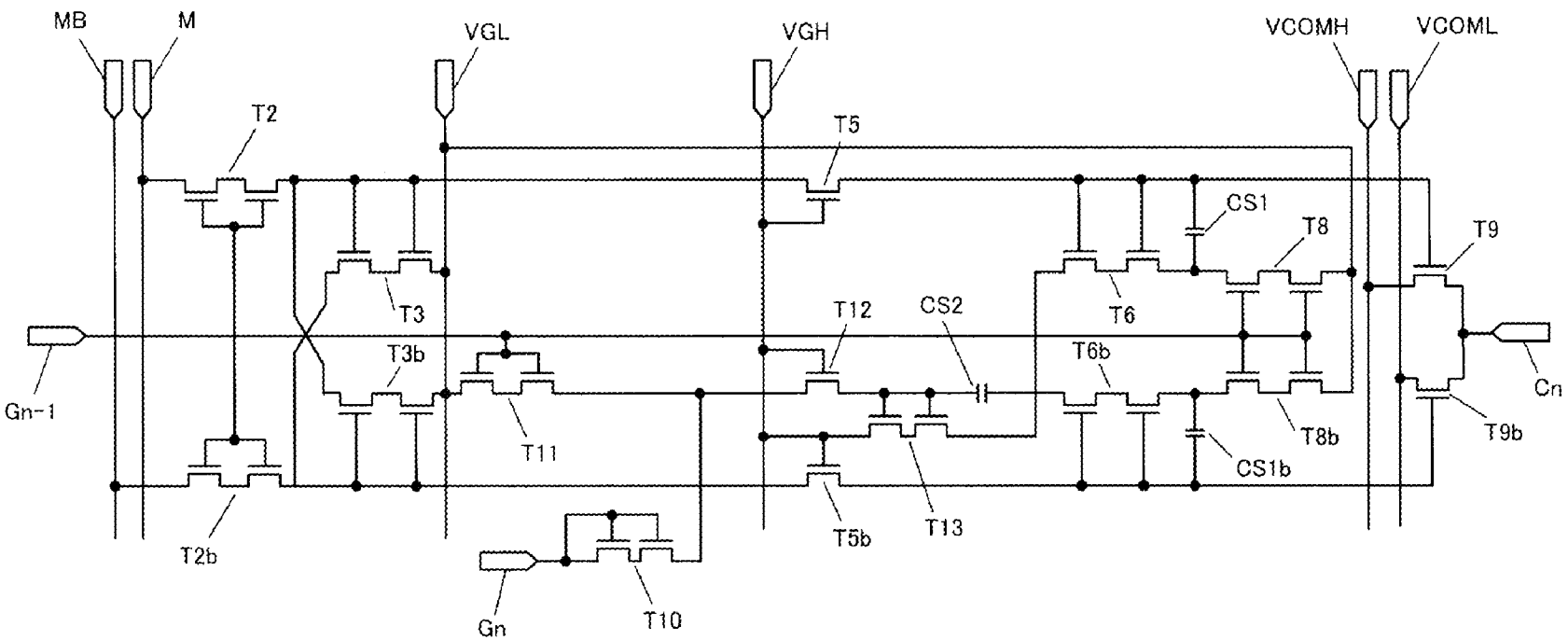
FIG. 10 is a circuit diagram showing the structure of a common driver circuit to which the basic circuit according to the second embodiment of the present invention is applied.

FIG. 10 shows the circuit when the basic circuit in FIG. 7 is applied to a common driver.

The basic circuit in FIG. 10 is different from the basic circuit in FIG. 7 in that the thin film transistors T2, T2*b*, T3, T3*b*, T6, T6*b*, T8, T8*b*, T11, Tun and T13 are each formed of two thin film transistors that are connected in series with the same voltage inputted into the gates, and the thin film transistor T10 in FIG. 7 is formed of two thin film transistors that are connected in series with the Gnth selection scan signal inputted into the gates.

As described above, the present embodiment is characterized in that there is a phase difference (Tms and Tmh) between the selection scan signal G and the alternating current signal M, as well as between the selection scan signal G and the inverse alternating current signal MB in a divided counter electrode driving system, in which counter electrodes CL in the pixels are divided so as to correspond to display lines and driven by counter electrode driving circuits provided for each display line.

As a result, a dedicated signal for resetting becomes unnecessary, and it is possible to eliminate thin film transistors for resetting. Thus it is possible to make the area for the counter electrode driving circuit smaller. As a result, it becomes possible to reduce the frame of the liquid crystal display panel in the liquid crystal display device in size.

In addition, the thin film transistors of the present embodiment are poly-Si thin film transistors where the semiconductor layer is a polysilicon (polycrystal silicon) layer.

In general polysilicon layers are fabricated by heating an amorphous silicon layer through irradiation with a laser beam. Therefore there is a great deal of inconsistency in the properties from transistor to transistor. When there are a large number of thin film transistors, as in the conventional basic circuit in FIG. 3, the probability of the entire circuit becoming defective due to inconsistency in the properties of the thin film transistors is high. However, when there are fewer thin film transistors, as in the basic circuit of the present embodiment, the probability of the entire circuit becoming defective due to inconsistency in the properties of the thin film transistors is low, an therefore it becomes possible to lower the cost.

Figure 11A:
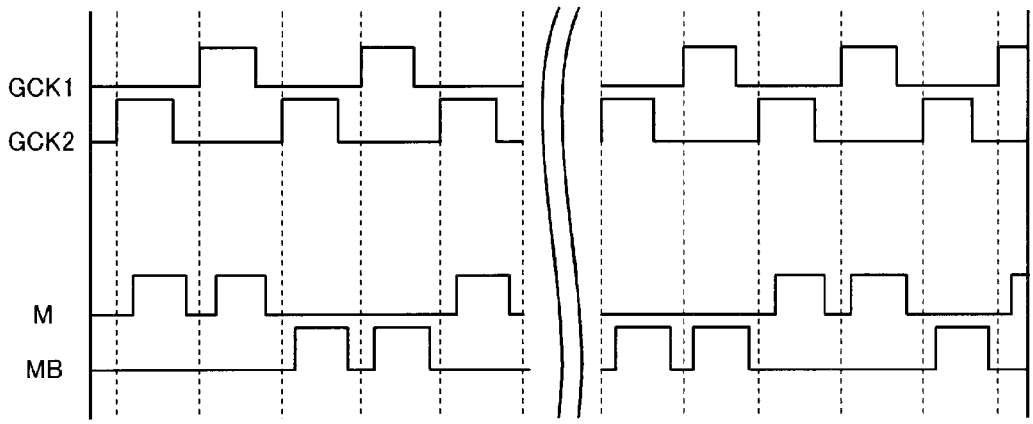
FIG. 11 is a diagram illustrating another example of the alternating current signal (M) and the inverse alternating current signal (MB) inputted in the common drivers according to the embodiments of the present invention.
Figure 11B:
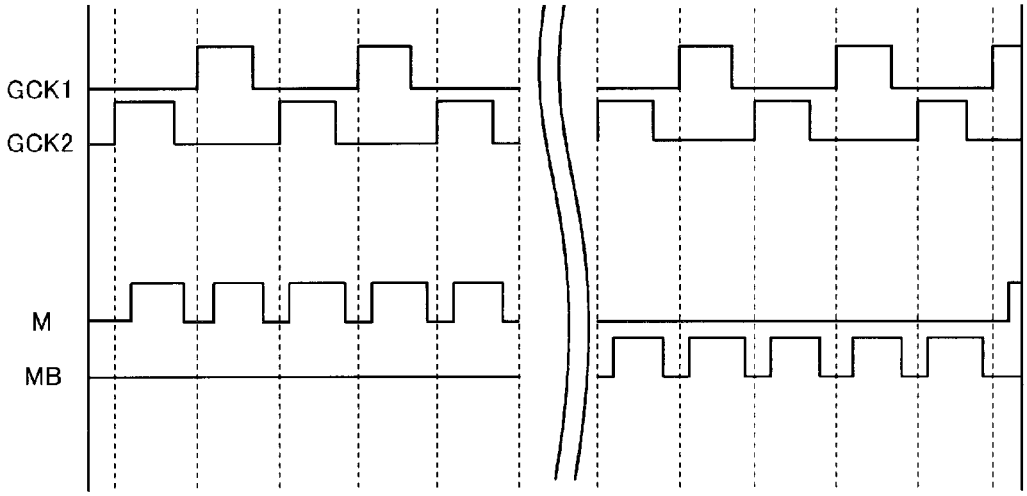

Though in the above description a case of a line by line alternating driving method where the polarity of the video voltage that is written into the pixels alternates line by line is used the alternating current driving system for the liquid crystal display device, a k lines by k lines alternating driving method where the polarity of the video voltage that is written into the pixels alternates every k lines and the signals shown in FIG. 11A are used as the alternating current signal M and the inverse alternating current signal MB (k=2 in FIG. 11A) is also possible. Furthermore, a frame by frame alternating driving method where the polarity of the video voltage that is written into the pixels alternates frame by frame is also possible if the signals shown in FIG. 11B are used as the alternating current signal M and the inverse alternating current signal MB.

In addition, though in the above description n type thin film transistors are used, it is also possible to use p type tin film transistors. Here, in the case where p type thin film transistor are used, the signal level and the voltage level of the reference voltages are, naturally, the opposite of in the case where n type thin film transistors are used.

Though the present invention is concretely described on the basis of the above embodiments, it is not limited to these embodiments, and various modifications are, naturally, possible, as long as they do not depart from the gist of the invention.

What is claimed is:

1. A liquid crystal display device, comprising:

a number of pixels;

M scan lines for inputting a scan signal in said number of pixels (M≧2);

M counter electrodes for inputting a counter voltage in said number of pixels;

a scan line driving circuit for supplying the scan signal to said M scan lines; and a counter electrode driving circuit for supplying the counter voltage to said M counter electrodes, wherein said counter electrode driving circuit has M basic circuits which are respectively connected to the M counter electrodes, the (n−1)th selection scan signal, the nth selection scan signal, an alternating current signal and an inverse alternating current signal are inputted into the nth basic circuit (1≦n≦M), said alternating current signal changes from a first voltage level to a second voltage level after said selection scan signal changes from the first voltage level to the second voltage level, and changes from the second voltage level to the first voltage level after said selection scan signal changes from the second voltage level to the first voltage level, and said inverse alternating current signal changes from the second voltage level to the first voltage level before said selection scan signal changes from the first voltage level to the second voltage level, and changes from the first voltage level to the second voltage level after said selection scan signal changes from the second voltage level to the first voltage level, or vice-versa, said basic circuits comprise:

a first output transistor for supplying a positive counter voltage to said nth counter electrode when in an on state;

a second output transistor for supplying a negative counter voltage to said nth counter electrode when in an on state;

a first transistor which turns on when said (n−1)th selection scan signal is inputted into the control electrode, takes in said alternating current signal and inputs said alternating current signal in the control electrode of the first output transistor;

a second transistor which turns on when said (n−1)th selection scan signal is inputted into the control electrode, takes in said inverse alternating current signal and inputs said inverse alternating current signal in the control electrode of the second output transistor;

a third transistor which turns on when the alternating current signal that is received by said first transistor is at the second voltage level and inputs a first reference voltage in the control electrode of said second output transistor;

a fourth transistor which turns on when the inverse alternating current signal that is received by said second transistor is at the second voltage level and inputs the first reference voltage in the control electrode of said first output transistor;

a fifth transistor of which the control electrode is connected to the control electrode of said first output transistor;

a sixth transistor of which the control electrode is connected to the control electrode of said second output transistor;

a first capacitor element that is connected between the control electrode of said fifth transistor and the second electrode of said fifth transistor;

a second capacitor element that is connected between the control electrode of said sixth transistor and the second electrode of said sixth transistor;

a seventh transistor which turns on when said (n−1)th selection scan signal is inputted into the control electrode and inputs the first reference voltage in the first electrode of said fifth transistor and the first electrode of said sixth transistor;

an eighth transistor which turns on when the nth selection scan signal is inputted in the control electrode and inputs a second reference voltage in the first electrode of said fifth transistor and the first electrode of said sixth transistor;

a third capacitor element that is connected between the control electrode of said eighth transistor and the first electrode of said sixth transistor; and a ninth transistor which turns on when said (n−1)th selection scan signal is inputted in the control electrode and inputs the first reference voltage in the control electrode of said eighth transistor.

2. The liquid crystal display device according to claim 1, characterized in that each of said first to eighth transistors is formed of two transistors that are connected in series, and the same voltage is inputted in the control electrodes of the two transistors that are connected in series.

3. The liquid crystal display device according to claim 1, characterized in that said nth selection scan signal is inputted in the control electrode of the eighth transistor via a diode-connected transistor.

4. The liquid crystal display device according to claim 1, characterized in that said nth selection scan signal is inputted in the control electrode of the eighth transistor via two transistors that are connected in series, and said nth selection scan signal is inputted in the control electrodes of the two transistors that are connected in series.

5. The liquid crystal display device according to claim 1, further comprising:

a twelfth transistor that is connected between the control electrode of said first output transistor and the control electrode of said third transistor, where the second reference voltage is inputted in the control electrode;

a thirteenth transistor that is connected between the control electrode of said second output transistor and the control electrode of said fourth transistor where the second reference voltage is inputted in the control electrode; and a fourteenth transistor that is connected between the second electrode of said ninth transistor and the control electrode of said eighth transistor, where the second reference voltage is inputted in the control electrode, characterized in that said nth selection scan signal is inputted in the control electrode of the eighth transistor via said fourteenth transistor.

6. The liquid crystal display device according to claim 1, characterized in that said output transistors and said transistors are thin film transistors having a semiconductor layer formed of polysilicon.

* * * * *